US007144360B2

(12) United States Patent
Zonneveld et al.

(10) Patent No.: US 7,144,360 B2
(45) Date of Patent: Dec. 5, 2006

(54) CENTRIFUGAL SEPARATOR WITH A SEPARATE STRIP INSERT MOUNTED IN THE BOWL

(75) Inventors: Edwin John William Zonneveld, Fort Langley (CA); Kurt Knabe, Coquitlam (CA); Brett Robert Henry Knelson, Langley (CA)

(73) Assignee: Knelson Patents Inc., Langley ( * ) Notice: Subject to any disclaimer, the term of this patent is extended or adjusted under 35 U.S.C. 154(b) by 0 days.

(21) Appl. No.: 11/103,636

(22) Filed: Apr. 12, 2005

(65) Prior Publication Data

US 2006/0135338 A1 Jun. 22, 2006

Related U.S. Application Data

(60) Provisional application No. 60/637,751, filed on Dec. 22, 2004.

(51) Int. Cl.
*B04B 11/04* (2006.01)

(52) U.S. Cl. ..... 494/29; 494/80

(58) Field of Classification Search ..... 494/23, 494/27–30, 56, 63, 80, 38, 43, 44–45, 64; 209/453; 210/360.1, 380.1
See application file for complete search history.

(56) References Cited

U.S. PATENT DOCUMENTS

| | | | | | |
|---|---|---|---|---|---|
| 459,197 | A | * | 9/1891 | Bodge | 210/365 |
| 459,858 | A | * | 9/1891 | Seymour | 494/47 |
| 489,101 | A | * | 10/1893 | Seymour | 209/199 |
| 556,567 | A | * | 3/1896 | Waring | 494/80 |
| 726,948 | A | * | 5/1903 | Land | 494/67 |
| 917,123 | A | * | 4/1909 | Peck | 494/29 |
| 957,478 | A | * | 5/1910 | Simpson | 494/30 |
| 980,001 | A | * | 12/1910 | Ponten | 494/35 |
| 981,679 | A | * | 1/1911 | Peck | 494/11 |
| 1,011,078 | A | * | 12/1911 | Peck | 494/11 |
| 1,012,097 | A | * | 12/1911 | Peck | 494/1 |
| 1,283,846 | A | * | 11/1918 | Mark et al. | 494/60 |
| 1,322,139 | A | * | 11/1919 | Schifferle | 494/28 |
| 1,473,421 | A | * | 11/1923 | Eccleston | 494/29 |
| 1,557,672 | A | * | 10/1925 | Doerner | 209/199 |
| 1,594,501 | A | * | 8/1926 | Eccleston | 494/29 |
| 1,599,502 | A | * | 9/1926 | Thomassen | 494/43 |
| 1,684,870 | A | * | 9/1928 | Lewis | 209/199 |

(Continued)

FOREIGN PATENT DOCUMENTS

| | | |
|---|---|---|
| AU | 22055 | 4/1936 |

(Continued)

*Primary Examiner*—Charles E. Cooley
(74) *Attorney, Agent, or Firm*—Adrian D. Battison; Michael R. Williams; Ryan W. Dupuis

(57) ABSTRACT

A centrifuge concentrator bowl includes a plurality of fluidized recesses at axially spaced positions along the peripheral wall. Each recess is defined by two side walls which has water injection holes for fluidizing materials collecting in the recess. Some of the recesses are at least partly defined by a removable insert member arranged to be attached to a suitable mounting on the wall of the bowl. Each insert member includes a face portion defining a surface facing toward the axis of the bowl for engaging the slurry and preventing wear. The face portion may include a side portion on one side or both sides located radially inwardly of a rib on a respective side of the recess and at least partly covering the rib so as to prevent the slurry from contacting the rib and causing wear to the rib.

35 Claims, 11 Drawing Sheets

U.S. PATENT DOCUMENTS

| | | | | | |
|---|---|---|---|---|---|
| 1,718,547 | A | * | 6/1929 | Eccleston | 494/29 |
| 1,750,860 | A | * | 3/1930 | Rawlings | 494/2 |
| 1,853,249 | A | * | 4/1932 | Ainlay | 494/43 |
| 1,882,389 | A | * | 10/1932 | MacIsaac | 494/11 |
| 1,935,547 | A | * | 11/1933 | Dryhurst | 494/67 |
| 1,988,500 | A | * | 1/1935 | Lack | 209/199 |
| 2,022,926 | A | * | 12/1935 | Schlank | 494/32 |
| 2,112,099 | A | * | 3/1938 | Mck Ballou et al. | 494/67 |
| 2,132,195 | A | * | 10/1938 | Stirn | 494/80 |
| 2,179,807 | A | * | 11/1939 | Asmussen | 494/27 |
| 2,230,013 | A | * | 1/1941 | Pecker | 494/58 |
| 2,272,675 | A | * | 2/1942 | Knudsen | 494/45 |
| 2,472,475 | A | * | 6/1949 | Hamilton | 209/199 |
| 2,782,925 | A | * | 2/1957 | Morton | 494/27 |
| 3,152,074 | A | * | 10/1964 | Fontein et al. | 210/781 |
| 3,256,993 | A | * | 6/1966 | Siepe et al. | 210/370 |
| 3,366,318 | A | * | 1/1968 | Steimel | 494/7 |
| 3,963,175 | A | * | 6/1976 | Daubman et al. | 494/74 |
| 4,279,741 | A | * | 7/1981 | Campbell | 209/44 |
| 4,286,748 | A | * | 9/1981 | Bailey | 494/29 |
| 4,361,480 | A | * | 11/1982 | Corbus et al. | 209/453 |
| 4,533,344 | A | * | 8/1985 | Gunnewig | 494/36 |
| 4,608,040 | A | * | 8/1986 | Knelson | 494/27 |
| 4,776,833 | A | * | 10/1988 | Knelson | 494/27 |
| 4,846,781 | A | * | 7/1989 | Knelson | 494/27 |
| 4,983,156 | A | * | 1/1991 | Knelson | 494/28 |
| 5,087,127 | A | * | 2/1992 | Knelson | 494/37 |
| 5,222,933 | A | * | 6/1993 | Knelson et al. | 494/29 |
| 5,230,797 | A | * | 7/1993 | Knelson | 210/380.1 |
| 5,338,284 | A | * | 8/1994 | Knelson | 494/28 |
| 5,354,256 | A | * | 10/1994 | Knelson | 494/80 |
| 5,368,541 | A | * | 11/1994 | Knelson | 494/37 |
| 5,372,571 | A | * | 12/1994 | Knelson et al. | 494/29 |
| 5,421,806 | A | * | 6/1995 | Knelson et al. | 494/37 |
| 5,462,513 | A | * | 10/1995 | McAlister | 494/56 |
| 5,586,965 | A | * | 12/1996 | Knelson | 494/29 |
| 5,601,524 | A | * | 2/1997 | Knelson | 494/29 |
| 5,601,532 | A | * | 2/1997 | Knelson | 494/29 |
| 5,713,826 | A | * | 2/1998 | West | 494/45 |
| 5,728,039 | A | * | 3/1998 | Knelson | 494/29 |
| 5,895,345 | A | * | 4/1999 | Knelson | 494/29 |
| 6,095,965 | A | * | 8/2000 | Eiderman et al. | 494/80 |
| 6,149,572 | A | * | 11/2000 | Knelson | 494/37 |
| 6,796,934 | B1 | * | 9/2004 | McAlister et al. | 494/56 |
| 6,869,389 | B1 | * | 3/2005 | Mackel et al. | 494/36 |
| 6,962,560 | B1 | * | 11/2005 | Grewal | 494/29 |
| 6,986,732 | B1 | * | 1/2006 | Zonneveld et al. | 494/29 |
| 6,997,859 | B1 | * | 2/2006 | Peacocke et al. | 494/29 |
| 2004/0121892 | A1 | * | 6/2004 | Zonneveld et al. | 494/67 |
| 2004/0132601 | A1 | * | 7/2004 | Peacocke et al. | 494/29 |
| 2005/0026766 | A1 | * | 2/2005 | Grewal | 494/29 |

FOREIGN PATENT DOCUMENTS

| | | | |
|---|---|---|---|
| CA | 2085064 | | 6/1993 |
| CA | 2443239 | | 3/2005 |
| DE | 2031350 | * | 12/1971 |
| JP | 58-24366 | * | 2/1983 |
| JP | 11-276110 | * | 10/1999 |

* cited by examiner

CENTRIFUGAL SEPARATOR WITH A SEPARATE STRIP INSERT MOUNTED IN THE BOWL

This application claims priority under 35 U.S.C. 119 from Provisional Application 60/637,751 filed Dec. 22, 2004.

This invention relates to a centrifugal separator of the type having a plurality of axially spaced annular recesses on a peripheral wall of a rotatable bowl.

In U.S. Pat. Nos. 4,608,040, 4,776,833, 5,222,933, 5,421,806, 5,230,797 and 5,338,284 of Benjamin Knelson and now assigned to the present Assignee discloses a number of different arrangements of centrifugal separator of the type including a rotatable bowl having a peripheral wall of generally frusto-conical shape on which is provided a plurality of axially spaced, annular recesses. The particulate material containing fractions of different specific gravity to be separated is fed in slurry form through a feed duct to a position at or adjacent a base of the bowl so that the feed materials pass over the peripheral wall with heavier particulate materials collecting in the annular recesses while lighter particulate materials escape from the bowl through the open mouth. In the above patents, all of the annular recesses are fluidized by the injection of fluidizing water through holes in the peripheral wall at the respective recesses thus acting to fluidize the collecting material within the recesses.

A further arrangement is disclosed in U.S. Pat. No. 5,586,965, issued Dec. 24th, 1996 of the above inventor in which the number of recesses is reduced and a frusto-conical lead-in section of the bowl is provided which is free from fluidized recesses so that the feed material is deposited onto the lead-in section and flows over that lead-in section prior to reaching the first annular recess.

In all cases the fluidized recesses are formed by providing drilled holes through the base of the recess in the manner disclosed in U.S. Pat. Nos. 4,608,040 and 5,230,797 above. This provides requirements on the construction and location of the holes which can lead to blockage and can limit the ability to tailor the arrangements to the best processing parameters.

In Australian Published Application 22,055/35 published $2^{nd}$ Apr. 1935 by Macnicol is disclosed a centrifuge bowl where the recesses on the peripheral wall are fluidized by injecting water through the wall and where the holes through the wall are covered by a band of screen material applied on the inside surface of the wall. The purpose of this screen is not explained. This device has not achieved commercial success and the disclosure has been long abandoned as a workable arrangement.

In Canadian Patent Application 2,085,064 of the above inventor published $12^{th}$ Jun. 1993 is disclosed an arrangement using the machine having conventional V-shaped recesses of the type disclosed in the above patents in which an annular insert of a screen mesh material is placed in each recess at a position spaced from the base of the recess and spaced from the mouth of the recess with the intention of forming a recess which is shallower than the conventional recess. The shallow recesses are intended to form a concentrate which is richer than that of a conventional concentrator since less material is collected in each recess and it is stated that the machine is intended to be used as a "final separator" in a process of repeated concentration. Thus the inventor intended that in a line of conventional separators, the last would be modified from the conventional by the addition the mesh material inserts to form the special shallow recesses for the last separator only.

In Canadian Application 2,443,239 filed Oct. 15, 2003 by the present assignees and published in December 2003 is disclosed an arrangement of the above type in which an insert ring is provided which is inserted into at least some of the recesses to define a base of the recess with the ring being perforated and spaced from the bottom of the recess. The ring is thus a replaceable item within the bowl.

Machines of this type have grown bigger and the tonnage capacities have increased which has lead to an increase in the associated wear problems. The concentrating bowl surface speed increases with the square root of the cone diameter for a constant g-force operation while wear rates are typically proportional to the velocity squared so that the wear rate is directly proportional to the cone diameter.

SUMMARY OF THE INVENTION

It is one object of the present invention to provide an improved centrifugal separator of the above general type in which wear problems are reduced by providing a replaceable insert.

According to a first aspect of the invention, therefore, there is provided a centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least some of the recesses each having a fluidizing liquid injection system for fluidizing the materials in the respective recess including a liquid supply and at least one liquid entry opening extending from the supply into the recess at or closely adjacent the base of the recess;

at least a part of at least one side wall of at least one of the recesses being formed from a recess insert member mounted in the bowl;

the recess insert member being elongate and shaped to extend only over a part of the height of the peripheral wall;

the recess insert member being elongate and shaped to extend around at least a part of the annular periphery of the peripheral wall;

the recess insert member being formed from a resilient material;

the recess insert member having at least one abutment element thereon for engaging a cooperating element of the bowl for holding the recess insert member in the bowl during rotation of the bowl;

the abutment element and the cooperating element being arranged such that the recess insert member is readily removable and replaceable.

In one embodiment described in more detail hereinafter, where the recesses are formed on the bowl wall by attached insert members, there are at least two recess insert members arranged at axially spaced locations where one defines the lower side wall of a recess and a second defines the upper side wall of a recess.

Preferably there is provided a perforated insert member mounted in the recess between the two recess insert members at a position therein so as to define a channel between the side walls, inwardly of the base and outwardly of the perforated insert member within which the fluidizing liquid from the liquid entry opening can flow within the recess, the perforated insert member having an inwardly facing surface which spans the space between the side walls at the perforated insert member so as to confine the materials within the volume of the recess defined by the side walls and inwardly of the inwardly facing surface of the perforated insert member, the perforated insert member having an array of fluid injection holes defined therethrough which allow the injection of jets of fluidizing liquid from the channel through the perforated insert member into the volume.

Preferably the recess insert member is shaped to define an upper side wall of one recess and a lower wall of a next adjacent recess with a slurry engaging surface of a rib therebetween.

Preferably the slurry engaging surface is shaped with at least one angularly extending recess thereon for contacting and changing slurry flow over the surface.

Preferably the recess insert member includes a layer of a material attached thereto at the surface which is of increased wear resistance relative to a main material from which the recess insert member is formed. In some cases however and in some designs a material may be available which can provide both the wear resistance and the flexibility so that the extrusion may be formed in one piece.

Preferably the layer is attached by adhesive.

Preferably wherein the peripheral wall of the bowl has attached thereto for the or each recess insert member a mounting member attached to the wall and extending inwardly from the wall for engaging an abutment member on the recess insert member.

Preferably the mounting member comprises an annular band carried on the peripheral wall.

Preferably the annular band defines shoulders for engaging into a channel on the recess insert member.

Preferably the liquid supply of the fluidizing liquid injection system for fluidizing the materials in the respective recess includes a channel defined between an exterior of the at least one recess insert member and an interior of the peripheral wall.

The side walls of the recesses are preferably v-shaped so as to converge toward one another. However this is not essential and many different shapes of the side walls of the recess can be provided. Thus the side walls and particularly the upper side wall may be curved or grooved with angular grooves to provide different effects on material tending to migrate from the recess over the upper wall. it will be appreciated that the fact that the recess is formed in a piece which is extruded longitudinally allows the cross sectional shape of the recess to be tailored to whatever shape is desired. This extrusion method provides much more flexibility of shape relative to the conventional one piece molding method which limits the shaping of the bowl and its recesses to shapes which can be pulled off the male mold.

The basic shape of the outer bowl wall, if a supporting bowl wall is used, is often frusto-conical as is conventional in this art. However the arrangements used herein allow different shapes of bowl wall to be used in view of the flexibility of the extrusion insert members used to define the recesses and the absence of the conventional one piece molding system. Thus the bowl wall may be wholly or partly cylindrical and may include partly conical and partly cylindrical sections with the conical sections being either inwardly converging or outwardly diverging. The bowl wall may also be curved in cross section.

In a second embodiment described in more detail hereinafter, which is used with a bowl already having molded recesses, the insert portion has a portion which inserts into the recess and a face portion including a side portion located radially inwardly of a rib on a respective side of the recess and at least partly covering the rib so as to prevent the slurry from contacting the rib and causing wear to the rib. However the face portion may be shaped so that it reduces the contact of the slurry on the rib without actually covering the rib, particularly if it projects into the bowl to a height above the rib.

Preferably the surface of the face portion extends across the recess and onto the side portion.

Preferably the surface is shaped to define at least one surface recess radially inwardly of the respective recess. However the surface can be readily tailored to particular requirements of a bowl since the surface can be inexpensively replaced. Thus the surface may have many different arrangements and characteristics which can be selected by one skilled in the art.

Preferably the face portion includes two side portions each on a respective side of the face portion and each arranged to cover a respective one of the ribs on alternate sides of the recess. However the face portion may cover or partly cover the rib on only one side. Alternatively insert members which do not cover either rib may be formed for use where two adjacent recesses have insert members so that only one of the insert members needs to and can cover the adjacent ribs.

Preferably the side portion has an edge at an axial end thereof and an edge surface extending from the edge to the next adjacent recess and wherein the edge surface is substantially contiguous with the side wall of the next adjacent recess. Thus the side portion covers the whole of the rib and an end face of the rib. However the side portion may not in some examples cover the whole of the rib provided the side portion is shaped to reduce or prevent the impact of the slurry on the rib sufficiently to avoid wear of the rib and to concentrate the wear in the replaceable insert member.

Preferably the rib has a radially inwardly facing surface and wherein the side portion has a radially outwardly facing surface in contact with and resting against the radially inwardly facing surface of the rib.

Preferably the insert member is annular and extends around the full periphery of the recess to fill the recess to define butting ends of the insert member. However it may be made in separate angularly divided pieces. The insert member may be manufactured in a length which is sufficient to extend around the largest diameter recess and thus may be cut to length for recesses of less diameter. Alternatively the insert members may be manufactured as a set pre-formed to the required length.

Preferably the insert portion of the insert member has side walls in contact with and resting against the side walls of the recess.

Preferably there are a plurality of insert members each located in a respective one of the recesses at axially spaced locations along the peripheral wall of the bowl so as to define at least one recess between one insert member and the next which is free from an inset member to allow entry of the slurry into the free recesses. These can be set out in the pattern previously proposed in the above U.S. Pat. No. 5,586,965. However alternative patterns of filled and open recesses can be used as will be apparent to one skilled in the art.

Preferably the surfaces of the face portions of the insert members lie on a common conical surface.

According to a second aspect of the invention there is provided a replacement insert member:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by an upper recess side wall on the upper side and a lower recess side wall on a lower side with each of the side walls extending generally outwardly from the axis from an open mouth of the recess toward a base of the recess at the peripheral wall and converging toward one another;

the upper side wall of each recess being connected to the lower side wall of a next adjacent recess to form a rib between the recesses such that the bowl includes a plurality of recesses and a plurality of ribs arranged alternately along the side wall;

at least some of the recesses each having a fluidizing liquid injection system for fluidizing the materials in the respective recess including a liquid supply and at least one liquid entry opening extending from the supply into the recess at or closely adjacent the base of the recess;

the replacement insert member comprising:

an elongate insert body having an insert portion shaped and arranged to fit into the recess;

the insert portion being arranged to be fastened into the recess so as to be located therein as the bowl is rotated;

the insert member having a face portion carried on the insert portion and arranged to be located radially inwardly of the recess and defining a surface facing toward the axis of the bowl such that, when in the recess, the slurry is prevented by the surface of the face portion from entering the recess.

According to a third aspect of the invention, directed to the bowl per se without the insert members located therein, there is provided a centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

the peripheral wall of the bowl having attached thereto a plurality of axially spaced annular bands each arranged for mounting thereon an abutment member of a respective one of a plurality of recess insert members, the abutment element and the annular band being arranged such that the recess insert member is readily removable and replaceable.

The embodiments described herein may provide some or all of the following features:

1) Protection of the cone's wear surface with a replaceable, sacrificial element.

2) Custom configuration of the number and order of fluidized/non-fluidized rings, especially in conjunction with the removable fluidization strip system shown and claimed in the above Canadian Application 2,443,239. This combination (strips and ring face/blocker extrusions) allows the manufacturer to custom configure a bowl with varying degrees of fluidization levels and with different hole size and spacing profiles to suit site/application requirements and water availability. It also allows adjustment of concentrate mass produced, again to suit site/application requirements but also to suit the downstream concentrate handling system's capabilities.

3) In addition to the additional extrusion profiles shown hereinafter, this system also allows the flexibility to provide a wide range of other inner face profiles on the extrusion for the purpose of enhancing inter-stage feed acceleration (inter-stage being from one fluidized ring to the next), inter-stage feed preparation (by introducing or reducing turbulence between the fluidized rings as desired), thereby enhancing metallurgical performance which can be customized on a case by case basis.

BRIEF DESCRIPTION OF THE DRAWINGS

One embodiment of the invention will now be described in conjunction with the accompanying drawings in which.

DETAILED DESCRIPTION

Figure 1:
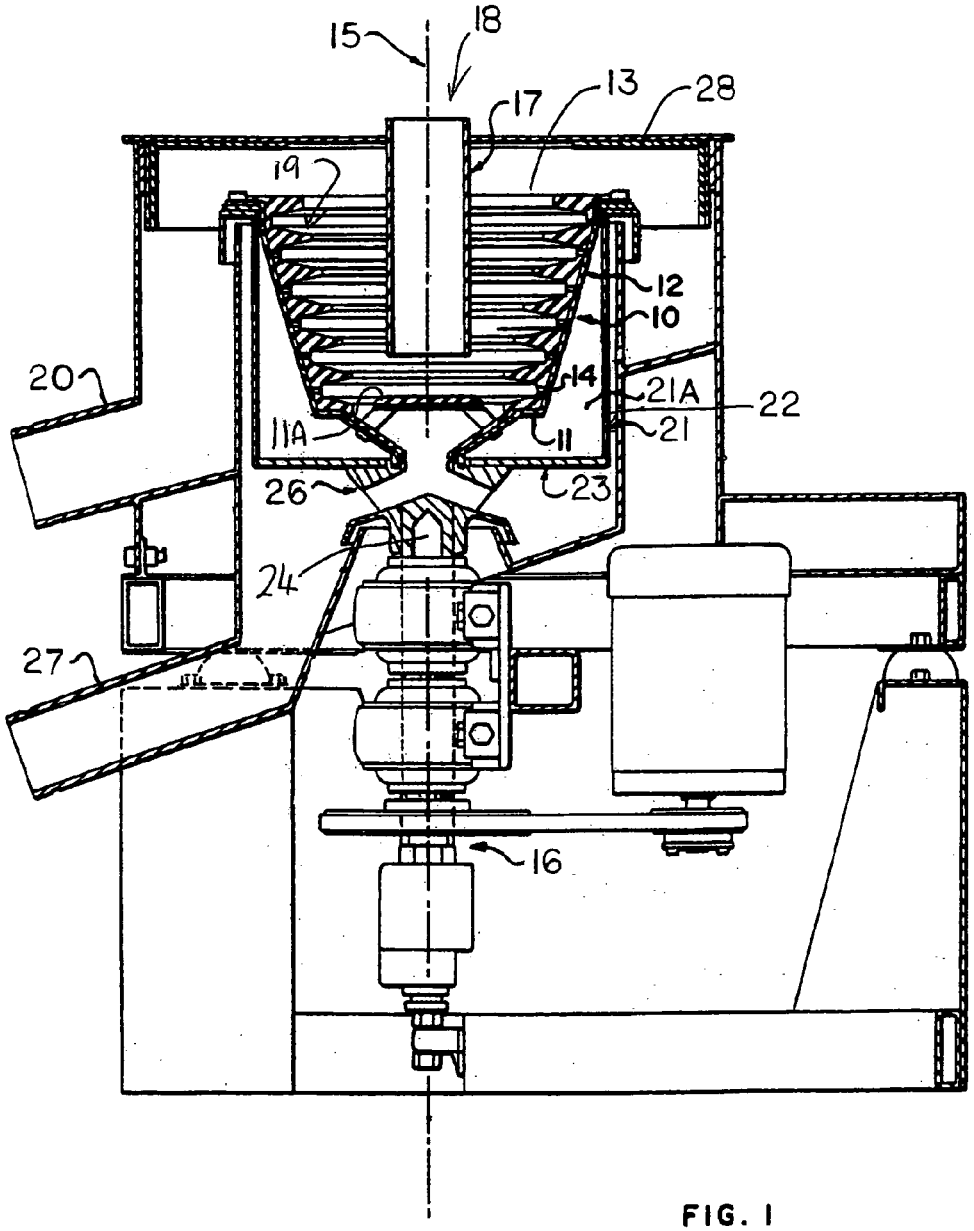
FIG. 1 is vertical cross sectional view through a centrifugal separator according to the present invention showing the separator in general.

The general arrangement of the centrifugal separator shown in FIG. 1 is taken from the above U.S. Pat. No. 5,222,933 of the present inventor and therefore will described only briefly in regard to the points of importance. The disclosure of the above patents of the present assignee may be referred to for further details which may be necessary for a full understanding.

The apparatus therefore comprising a bowl generally indicated at 10 having a base generally indicated at 11 and a peripheral wall 12 standing upwardly from the base to an open mouth 13. The bowl can rotate around an axis 15 on a support shaft 16.

A feed duct 17 carries feed materials 18 in the form of a mixture of heavier and lighter particulate materials in a water slurry through the open mouth to a position adjacent to the base so the feed materials can be deposited onto a horizontal guide plate 11A at the base 11 and can move therefrom onto the peripheral wall 12 for separation of the heavier materials into a plurality of recesses 19 on the peripheral wall while the lighter materials in the slurry pass over the peripheral wall to the open mouth for discharge. The recesses are annular and are axially spaced. The peripheral wall is frusto-conical so that the diameter of the recesses increases from a first recess at the base to a last recess at the open mouth. Material exiting from the open mouth is collected by a launder 20 for discharge.

Around the bowl 10 is provided a jacket 21 having a peripheral wall 22 and a base 23 both of which are connected to the respective elements of the bowl so as to form a compartment 21A fed with fluidizing water from a central duct 24 of the shaft 16 through connecting ducts (not shown). The compartment 21A therefore receives fluidizing water under pressure which is communicated through openings in the peripheral wall 12 into the recesses for adding fluidizing water into the material collecting in the recesses.

The separation and collection process is a batch process so that the heavier material is collected in the recesses for subsequent wash down and collection. The collected materials when washed down to the base pass through a discharge opening 26 into a second collection system 27 for collecting the concentrate.

The feed duct 17 comprises a cylindrical tube carried on a cover 28 of the launder 20. Thus the tube forming the feed duct is in fixed position and remains stationary as the bowl rotates around the axis 15.

Figure 3:
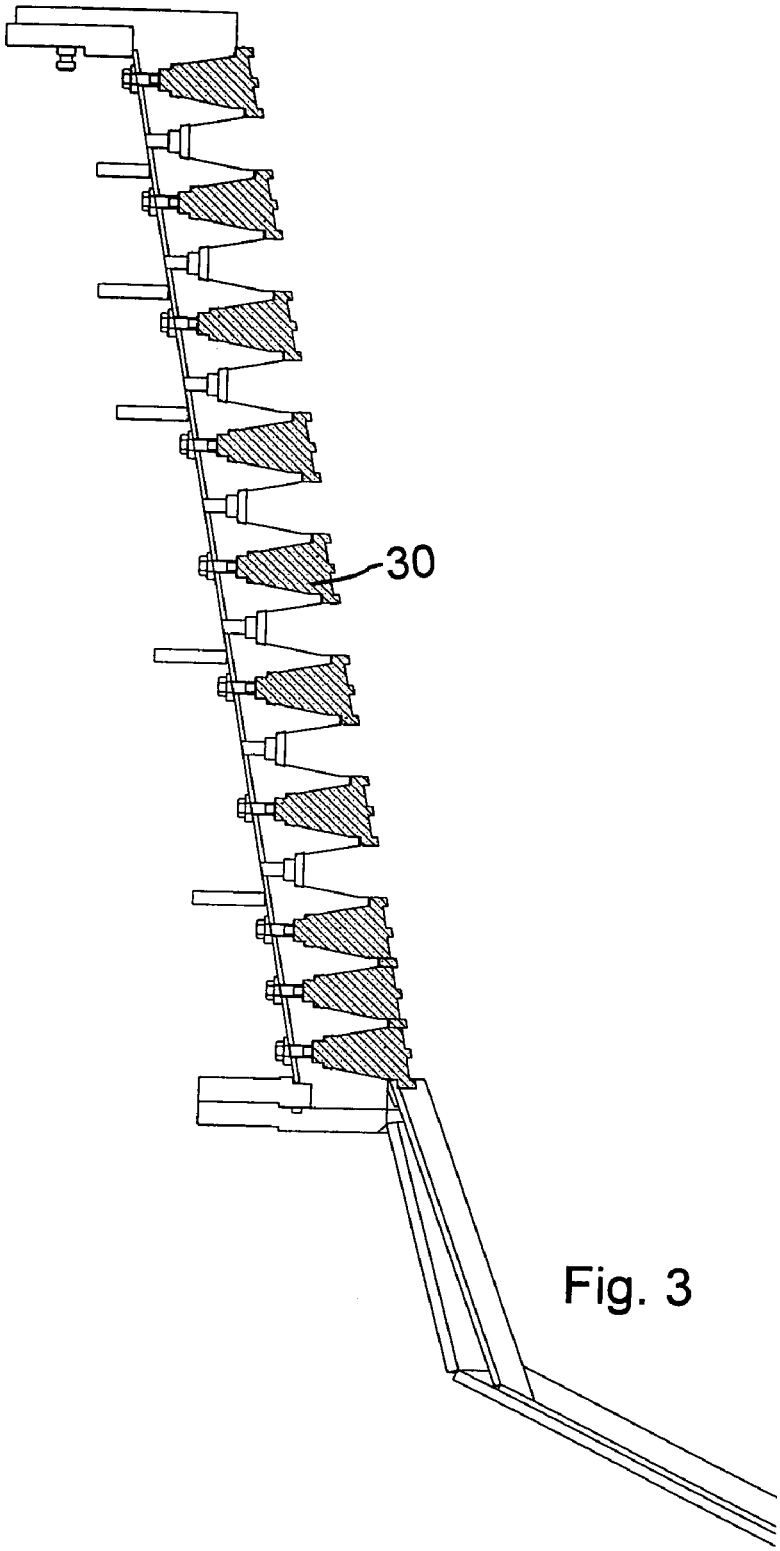
FIG. 3 is a cross sectional view similar to that of FIG. 2 showing an alternative configuration of the recesses of the bowl.

The recesses 19 are generally of the type previously described in earlier patents and include, as shown in FIG. 3, side walls which converge generally outwardly from the axis toward a base of the recess which is narrower than an open mouth of the recess. The base has a width sufficient so that the holes 25 pass through the peripheral wall of the bowl into the base so that the fluidizing water in the compartment 21A can pass through the holes to fluidize the materials within the recess 19.

As described in detail in the above U.S. Pat. No. 4,776,833, the recesses are formed by molding a resilient liner material on the inside surface of the bowl. Thus the bowl is structurally formed from a metal wall which is generally frusto-conical onto the inside surface of which is molded the liner including the recesses. The liner material is generally a resilient plastics material such as urethane which is resistant to wear since it can flex under the impact from the materials.

Figure 2:
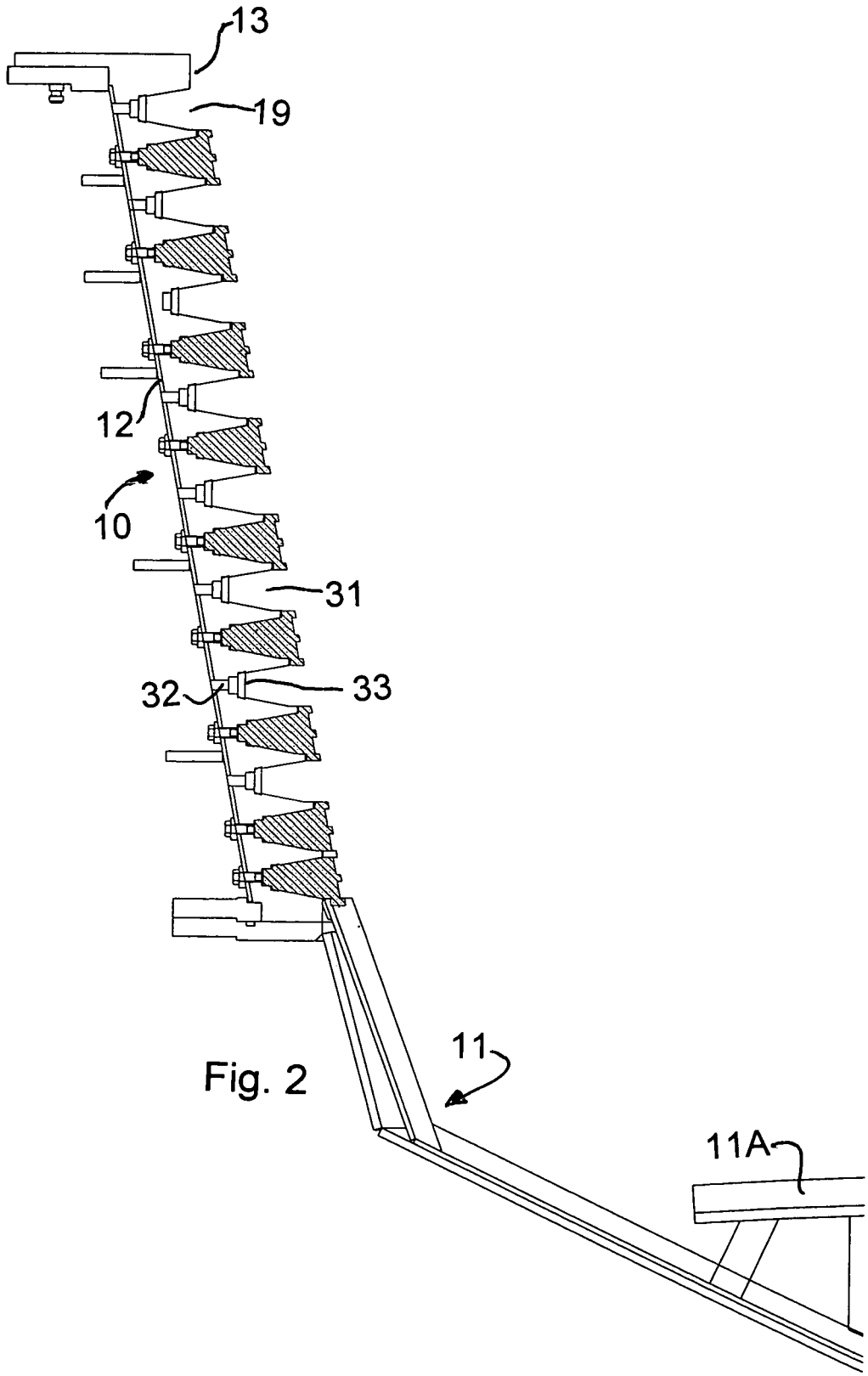
FIG. 2 is a cross sectional view through a part of the bowl only of FIG. 1 on an enlarged scale and showing the components related to the present invention.
Figure 4:
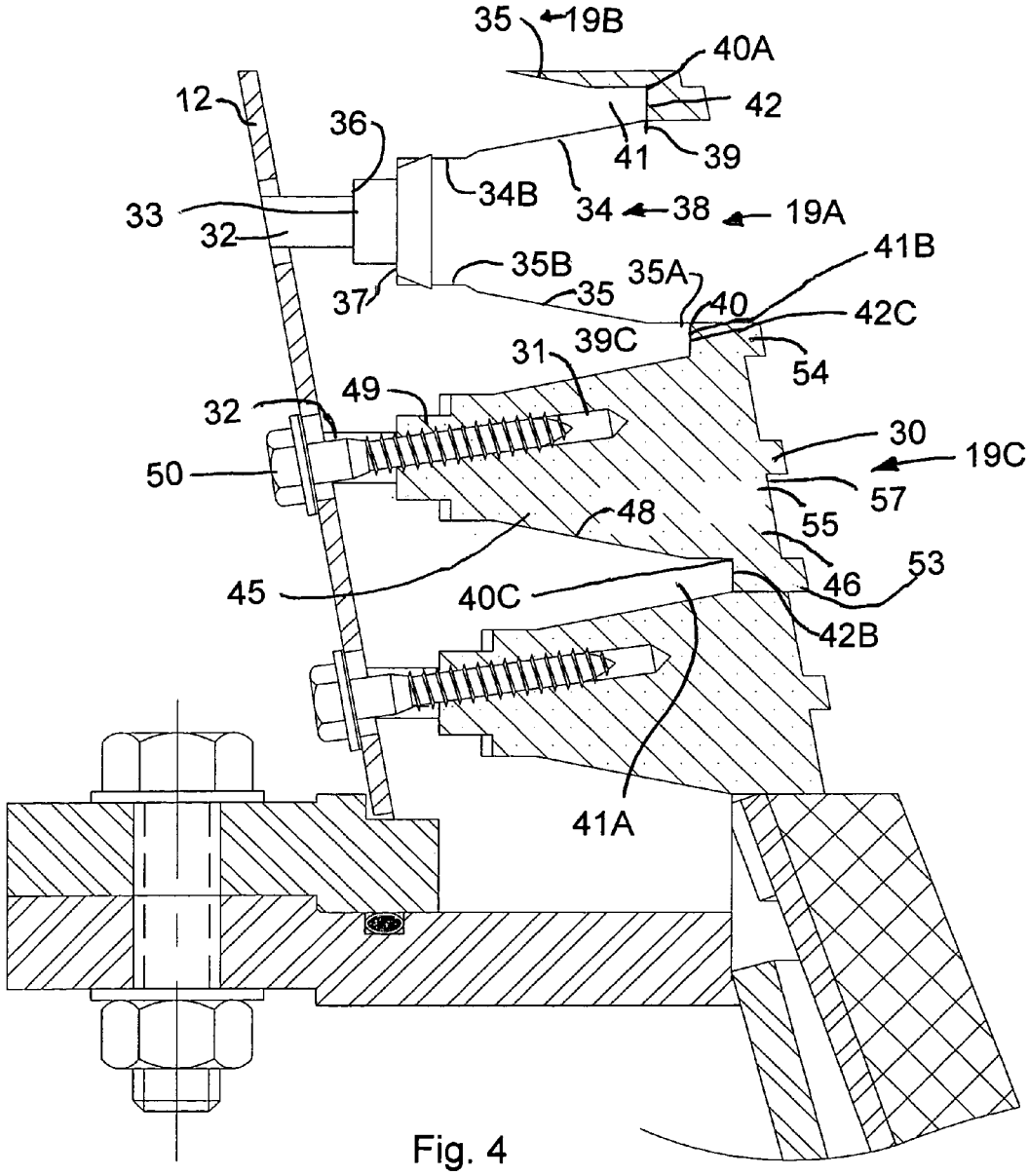
FIG. 4 is a cross sectional view similar to that of FIG. 2 on an enlarged scale showing the mounting of the insert member in the recess.
Figure 5:
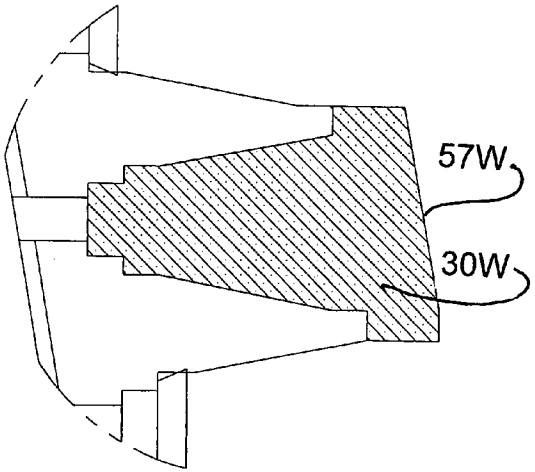
FIGS. 5, 6, 7 and 8 are cross sectional views similar to that of FIG. 4 showing modified embodiments of the insert member.

In FIGS. 2, 3 and 4 is shown the arrangement of the present invention in which a bowl having a series of adjacent recesses has some of the recesses filled with an insert member generally indicated at 30. Thus the bowl 10 includes the peripheral wall 12 which has a series of recesses 19 extending in axially spaced position from the base generally indicated at 11 up to the open mouth 13. The number of recesses can of course vary in accordance with the size of the bowl. Shape and arrangement of the base can also vary in accordance with design characteristics as will be well known to one skilled in the art.

In the embodiment shown in FIGS. 2 and 3 there are a series of the insert members 30 so that each insert member 30 is inserted into a respective one of the recesses 19 so as to block off that recess so that it is no longer acting as a recess of the fluidized type.

In between each recess containing an insert member 30 is provided a fluidized recess indicated at 31 which is of the type shown in published Canadian application 2,443,239 which provides an insert ring at the base of the recess described in detail therein, the disclosure of which is incorporated herein by reference or to which reference may be made. Liquid is injected from the area 21A of the jacket through holes 32 in the wall. The insert ring is indicated at 33 and is located adjacent the base of the recess. Each recess includes an upper side wall 34 and a lower side wall 35 which extend from an open mouth 38 of the recess radially outwardly from the axis of the bowl toward a base 36 of the recess. The side walls 34 and 35 may be flat so that they converge together at a constant angle or they may, as shown include portions indicated at 35A, 35B and 34B which are at a different angle, and as shown are approximately in a radial plane of the axis of the bowl.

It will be noted that in the embodiment shown the recess at the base includes a shoulder 37 which is shaped to receive the insert ring 33 of the previous application. In an embodiment where the insert ring 33 is omitted and the fluidization is injected directly into the recess, such a shoulder and shaping of the recess adjacent the base 36 may be omitted.

The open mouth 38 is located at the radially inner edges of the side walls 34 and 35. Thus the side wall 34 terminates at an edge 39 and the side wall 35 terminates at an edge 40. As shown in FIG. 4, one of the recesses indicated at 19A and the next adjacent recess is indicated at 19B. A next adjacent recess on the opposite sides indicated at 19C. Each of these recesses 19A, 19B and 19C has the same side wall construction. Thus as shown at the junction between the recesses 19A and 19B there is defined a rib 41 between the upper side wall 34 of the recess 19A and the lower side wall 35 of the recess 19B. The side walls converge inwardly toward the axis of the bowl and terminate at the edges 39 and 40A. Between the edges 39 and 40A is formed a shoulder or surface 42 which faces inwardly toward the axis of the bowl. The shoulder or surface 42 is of course annular and surrounds the axis as a "land" between the two recesses. This shape is of course conventional in bowls of this arrangement and is shown in many of the previous patents identified above.

The recesses thus formed can be used in a bowl in which all of the recesses are fluidized simply by omitting the insert member 30. In this case all of the recesses have the insert rings 33 introduced into the base of the respective recess and all of the recesses act as fluidized recesses in the manner described in the above Canadian application.

However in the present arrangement, it is desired that some of the recesses are blocked by introduction into the recess of the insert member 30. It will be appreciated that the configuration of the bowl in relation to the number and location of insert members can be selected in accordance with design requirements utilizing the knowledge of one skilled in the art. In FIG. 2 is shown a first configuration in which the bottom two recesses each include an insert member 30. In the configuration of FIG. 3 the bottom three recesses contain insert member 30. In an arrangement where the bowls have the same number of recesses, this provides a construction in which the top recess in FIG. 2 is fluidized recess and the top recess in FIG. 3 is a closed recess having the insert member 30. These configurations follow generally the construction shown in the above U.S. patent where the lowermost recesses are closed following which the recesses alternate between closed and fluidized recesses. This arrangement is used to reduce the quantity of concentrate collecting in the bowl since the number of fluidized recesses and therefore the total volume of fluidized recesses is reduced. This arrangement also reduces the quantity of fluidizing water. Depending upon the amount of fluidizing water available and the amount of concentrate required, selections of bowl configurations can be made.

Each insert member 30 as shown in the recess 19C comprises an insert portion 45 and a face portion 46 carried by the insert portion. The insert portion is generally shaped to match the shape of the recess so that inserts within the recess toward the base of the recess. Thus the insert portion has side walls 47 and 48 matching the side walls 34 and 35 respectively. Thus the insert portion has a base section 49 generally matching the selected shape of the base of the recess. The insert portion is held in place within the recess in the example shown by a screw 50 which is inserted through the drilled hole 32 and engages into the insert portion. The number of screws around the recess can be selected to ensure that the insert portion is held in place sufficiently to be retained within the insert portion during operation of the bowl.

Alternate techniques for fastening the insert portion into the bowl can be used which avoid the necessity for dismantling the bowl and removing the jacket which is necessary in the example shown since the screws are accessible only within the area 21A. Preferably a mounting arrangement utilizes a shape of the insert portion which engages an element within the recess so that the insert portion can be clipped into place with sufficient force to remain in situ during operation.

The face portion 46 extends radially inwardly from the edges 39C and 40C of the recess 19C. Thus the face portion includes a central area extending radially inwardly from the edges 40C and 39C and side portions 53 and 54 each on a respective side of the central area 55. The side portions 53 and 54 cover respectively the surfaces 42B and 42C defined by the ribs 41A and 41B. These ribs are located on respective sides of the recess 19C. Thus the face portion 46 covers the mouth of the recess 19C together with the ribs 41A and 41B so that the slurry which is fed into the bowl is prevented from accessing either of the ribs. The face portion 46 defines a radially inwardly facing surface 57 which is generally conical so as to follow the conical shape of the wall of the bowl at the same or approximately the same angle.

Each of the side portions 53 and 54 is shaped to cover the rib 41A and 41B and particularly the surfaces 42B and 42C. Thus the side portion has a bottom surface sitting directly on and co-extensive with the surface 42B and 42C respectively. In this way a side surface of the side portion extends from an edge of the side portion to the edge 40 of the recess so as to be contiguous with the surface 35 of the recess.

In this way the side portion of the face portion covers the rib and provides a short extension of the next adjacent recess 19A so that the side wall 35 of the next adjacent recess 19A extends to its edge 40 and then extends along the side surface of the face portion of the insert member 30 to form a slightly deeper recess.

In this way the insert members 30 contact the moving slurry and prevent the moving slurry from engaging the ribs to cause wear of the ribs. Instead the wear caused by the slurry as it moves across the rapidly rotating bowl is applied to the inner surface 57 of the insert members which are applied as readily replaceable wear members to avoid applying significant wear to the lining material of the bowl which is much more difficult to replace.

It will be appreciated that the material within the recesses is relatively stable and stationary so that the wear to the recesses themselves is relatively light. The wear occurs at the rapid relative movement between the slurry and the bowl and this wear is now transferred to the generally conical surfaces of the insert members 30, all of which or some of which can be replaced as soon as the wear becomes excessive.

As shown in the bottom recess of FIG. 4, some of the insert members necessarily omit side portions so that the face portion is defined solely by the area covering the respective recess. Such side-less insert members are used adjacent the insert members with side portions since the side portion of the adjacent insert member already covers the respective rib leaving no room for a side portion on the insert member of the bottom recess. These side portions can be removed on site by simply slitting away the side portion. Alternatively a separate extrusion may be formed for the insert members which have only one side portion or no side portions as is required for the various optional configurations shown in FIGS. 2 and 3 and which could be used if required for different configurations.

As shown in FIG. 4, the surface 57 carries a pair of annular recesses defined between three ribs at axially spaced positions along the face 57. Thus the single recess 19C is replaced by two shallow recesses located radially inwardly of the original recess 19C.

In the arrangement shown in FIGS. 5, 6, 7 and 8 there are alternative constructions of the face portion of the insert member. Thus in FIG. 5 the insert member indicated at 30W is substantially identical to the insert portion previously described except that the surface 57W is substantially flat and conical so as to be formed without the recesses and ribs of the previously described arrangement.

Figure 6:
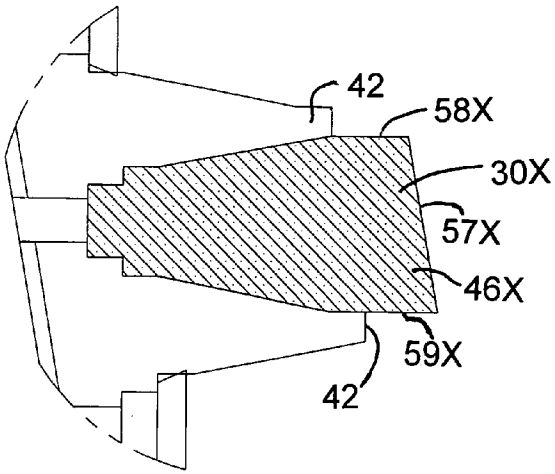

In the arrangement of FIG. 6, the insert member 30X has the face portion 46X thereof which is formed with a surface 57X which is again conical so as to be free from the ribs and recesses previously described. In addition the face portion 46X omits the side portions so that the side surfaces 58X and 59X extend to the side wall of the respective recess and do not cover the surfaces 42.

Figure 7:
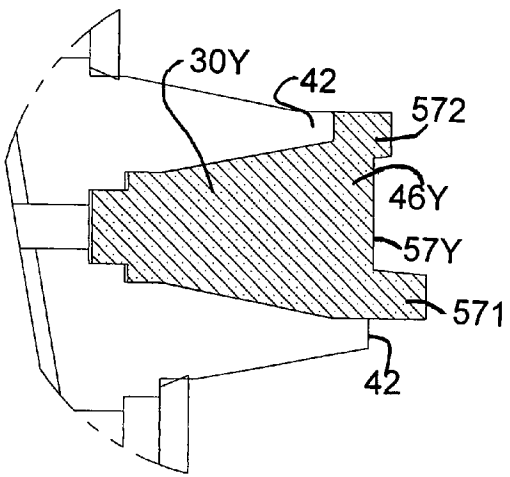

In the arrangement shown in FIG. 7, the face portion 46Y of the insert member 30Y has a surface 57Y which forms a rib 571 and a second rib 572 on the opposite side with a single recess therebetween. The rib 571 is of an increased height relative to the rib 572 so as to provide an increased resistance to the flow of slurry moving generally upwardly of the bowl with the possibility of increasing or changing turbulence within the slurry.

The face portion 46Y covers only one side so that it covers the rib 42 on the upper side but does not cover the rib 42 on the lower side.

Figure 8:
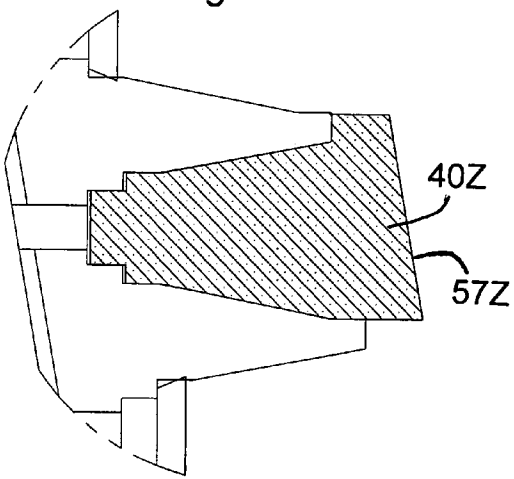

In FIG. 8 is shown a further alternative arrangement similar to the arrangement in FIG. 7 where the face portion 46Z covers the upper rib but not the lower rib but in this arrangement the face portion defines a surface 57Z which is merely flat and conical.

Figure 9:
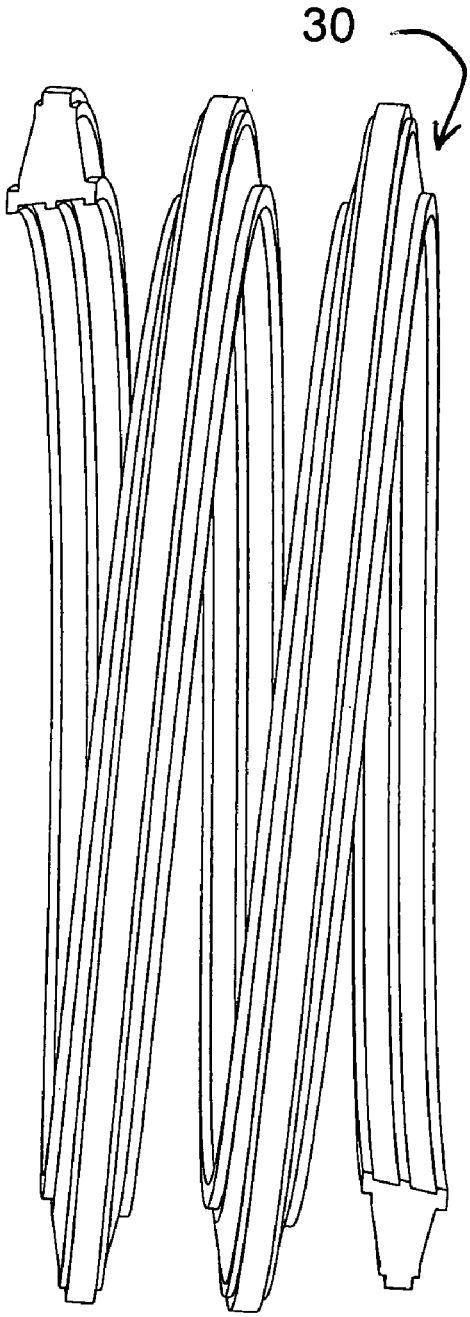
FIG. 9 is an isometric view of an insert member prior to insertion into the recess.

In FIG. 9 is shown the insert member which is extruded as an elongate body so that it can be rolled into a rolled supply. The extrusion can be continuous so that it can be cut to length to match the circumference of each of the respective recesses which vary throughout the height of the bowl due to the different diameters. Alternatively, the extruded insert member can be formed as a set of inserts previously cut to length ready to be inserted into the respective recesses.

When cut to length, a single piece of the insert member is inserted over the full circumference of the respective recess to provide butting ends of the insert member so that the recess is fully closed around its full periphery.

Turning now to the second main embodiment shown in FIGS. 10 through 14, there is shown a portion of the bowl wall indicated at 60 with the remainder of the bowl being substantially as previously described. In this embodiment there are a series of recesses 61 separated by ribs 62 so that an upper side wall 63 of one recess is connected to a lower side wall 64 of the next adjacent recess to define the rib 62 therebetween with a surface 64 which engages the slurry.

Figure 11:
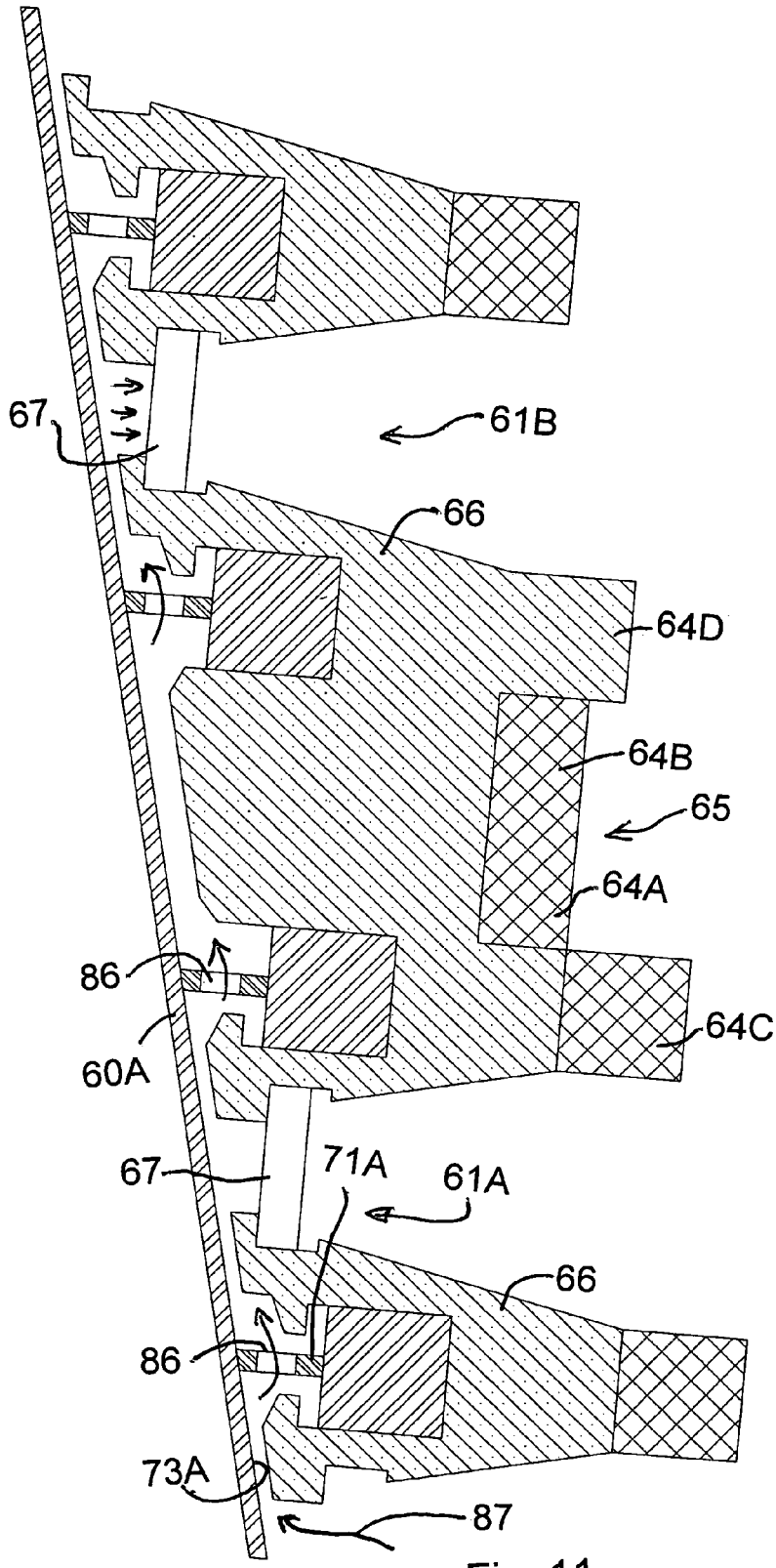
FIG. 11 is a similar cross sectional view through a further embodiment of a bowl of a similar construction to that of FIG. 10.

In the arrangement of FIG. 11 one of the ribs indicated at 65 between a recess 61A and the second recess 61B is of increased width so that it in effect defines a non fluidized area between the two fluidized recesses 61A and 61B. In this embodiment the surface 64A of the rib 65 is modified to define a shallow non fluidized recess 64B between two upstanding rib portions 64C and 64D. The rib portion 64C is of increased height relative to the rib portion 64D. All of these elements are of course annular surrounding the full periphery of the bowl. This shape corresponds to shapes known from the previous patents mentioned hereinbefore.

Figure 12:
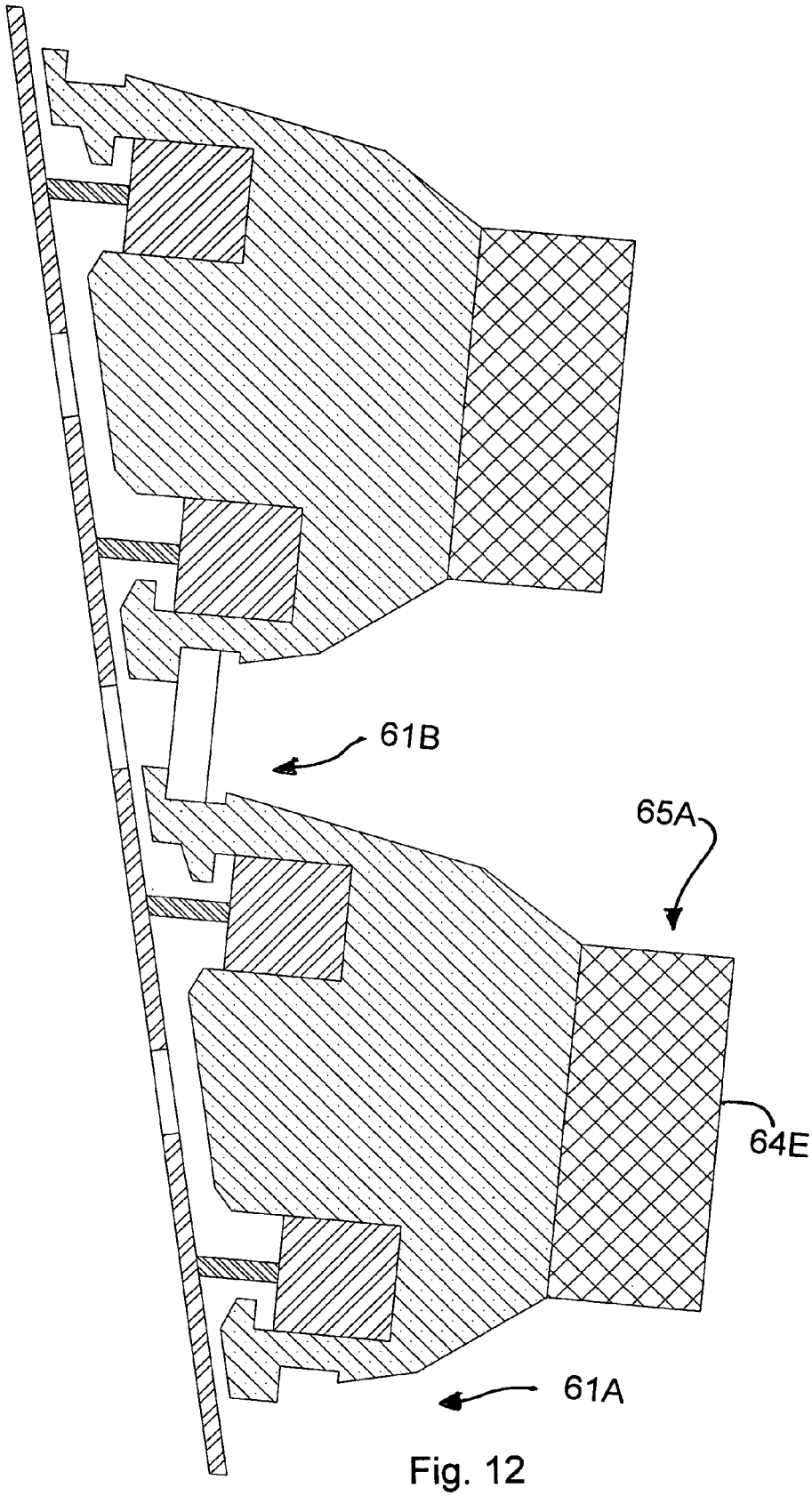
FIG. 12 is a cross sectional view similar to that of FIGS. 10 and 11 showing a further embodiment of a similar arrangement.

In FIG. 12 is shown a yet further modification in which the rib 65A is again of a width to form a non fluidized area between two recesses 61A and 61B. However in this case the surface 64E is merely a flat surface lying in a cylindrical plane surrounding the axis of the bowl.

Figure 13:
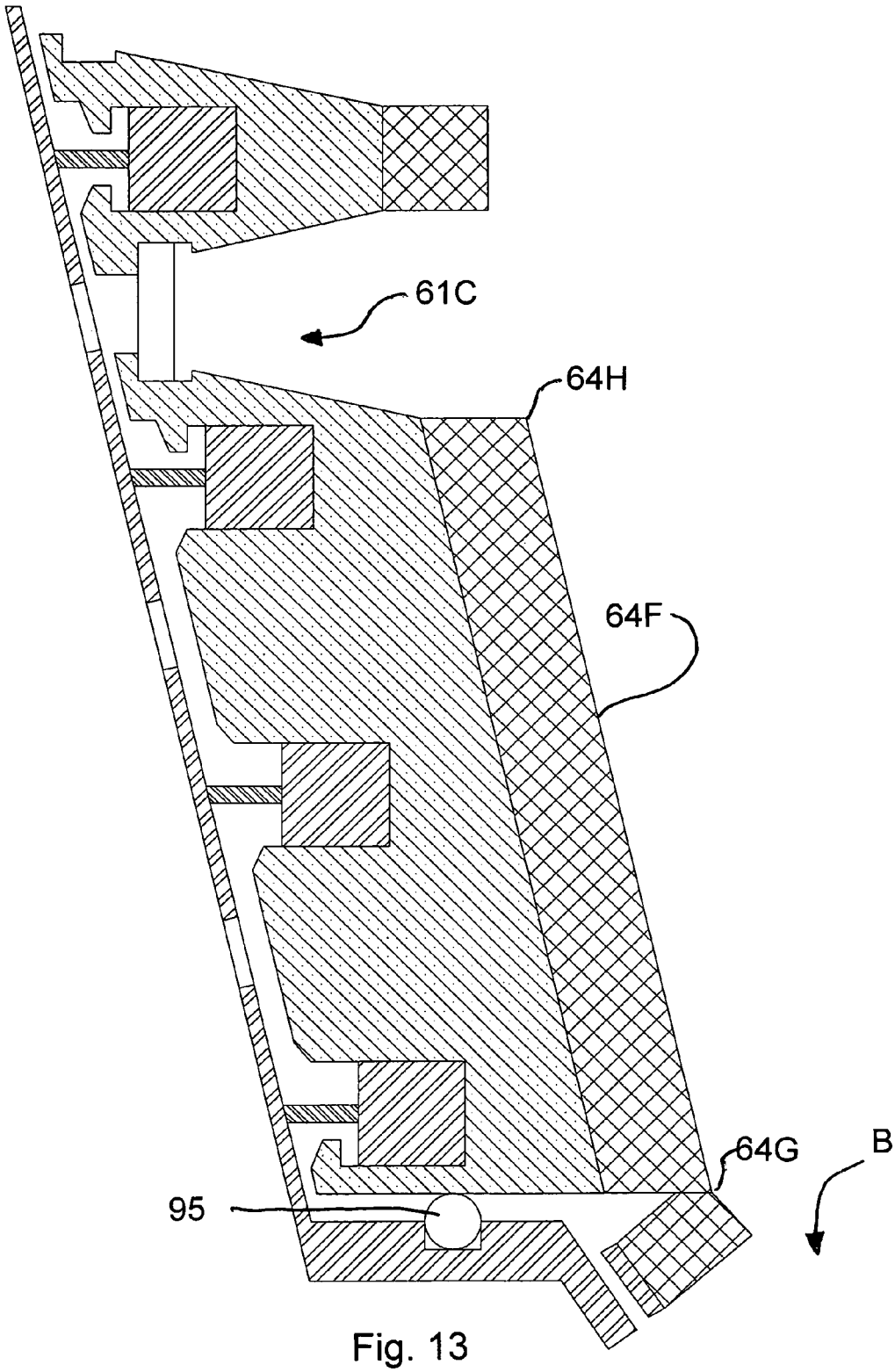
FIG. 13 is a similar cross sectional view through a yet further embodiment.

In FIG. 13 a yet further embodiment is shown for defining the particular shape shown in previous patents in which a frusto conical surface 64F is defined adjacent the base B of the bowl. In this case the surface 64F replaces in effect three fluidized recesses so that a single device in the form of a rib extends from the base B to a first recess 61C of the bowl. In this case the surface 64F is frusto conical extending from a bottom edge 64G to a top edge 64H. The shape and operation of a surface of this type is described in the above previous patents.

In each of the embodiments, the elements of the bowl defining the recesses 61 and the ribs 62 are provided by recess insert members 66 and by insert members 67.

The insert members are generally perforated to provide fluidization of the recess. However in some cases blank or imperforate insert members or rings can be used to provide a recess of the same depth as the fluidized recesses but which is blocked off to provide a non-fluidized recess.

These co-operate to define the required shape of the rib and the required shape of the recess together with the perforated base of the recess as described in the above published Canadian application. The recess insert members 66 are molded from a resilient plastics material to define a body 67 having a channel shaped receptacle 68 for mounting on a mounting ring 69 of the bowl. The resilient body 67 is formed by extrusion to form an annular structure which can be applied around a periphery of the bowl onto the mounting ring 69 with butting ends of the annular member completing the annulus around the bowl. The extruded body 67 can be cut to length since the length will vary at different positions along the axial height of the bowl. On top of the body 67 is provided a wear resistant liner 70 which is bonded onto a surface 67A by a suitable adhesive layer. The liner 70 thus defines the inside surface 64. Thus the liner 70 defines a portion of the respective side wall of the respective recess. The liner 70 is of course again annular and surrounds the axis of the bowl. The liner 70 is formed from a suitable wear resistant material which has a greater resistance to wear than the body 67. This material therefore may be less resilient and less resilient than is required to allow the body 67 to be snapped into place over the mounting ring 69. The use of the two materials therefore allows the complete recess insert member 66 to provide the necessary characteristics at the required location of wear resistance and resilience.

The mounting member for the recess insert member comprises the ring 69 in the form of a square ring which is carried on a flange 71 welded at its outside edge 72 to the inside surface 73 of the peripheral wall. An outside edge 74 of the flange 71 is welded to the square ring 69. This defines outwardly facing shoulders 75 which act to engage under abutment flanges 76 of the channel 68 to hold the recess insert member 66 on the mounting ring. An inwardly facing surface 77 of the mounting ring abuts against a surface 78 of the insert member so that centrifugal forces on the insert member tend to press it against the support surface 77 so that it is maintained in place. Sides 79 of the ring 69 prevent the insert member from moving axially within the bowl.

The insert member 66 thus defines the lower surface 63 of a recess and the upper surface 64 of the next adjacent recess. Each of these surfaces is shaped with a recess 80 defined by shoulders 81 and 82 forming an angularly extending channel around the base of the recess 61. The channel thus receives the perforated insert member 67 which has holes 83 of the shape and arrangement and dimensions as described in the above Canadian published application. As the channels 80 are provided with the shoulders 81 and 82, the side edges of the strip 67 forming the perforated insert member can be simply flat lying in spaced radial planes of the axis of the bowl since the strip is held in place by the shoulders and prevented from moving inwardly or outwardly relative to the axis of the bowl by those shoulders. This simplifies the shape and construction of the strip 67 to avoid the necessity for tines or sharpened edges for engaging into the side walls of the recess.

Figure 10:
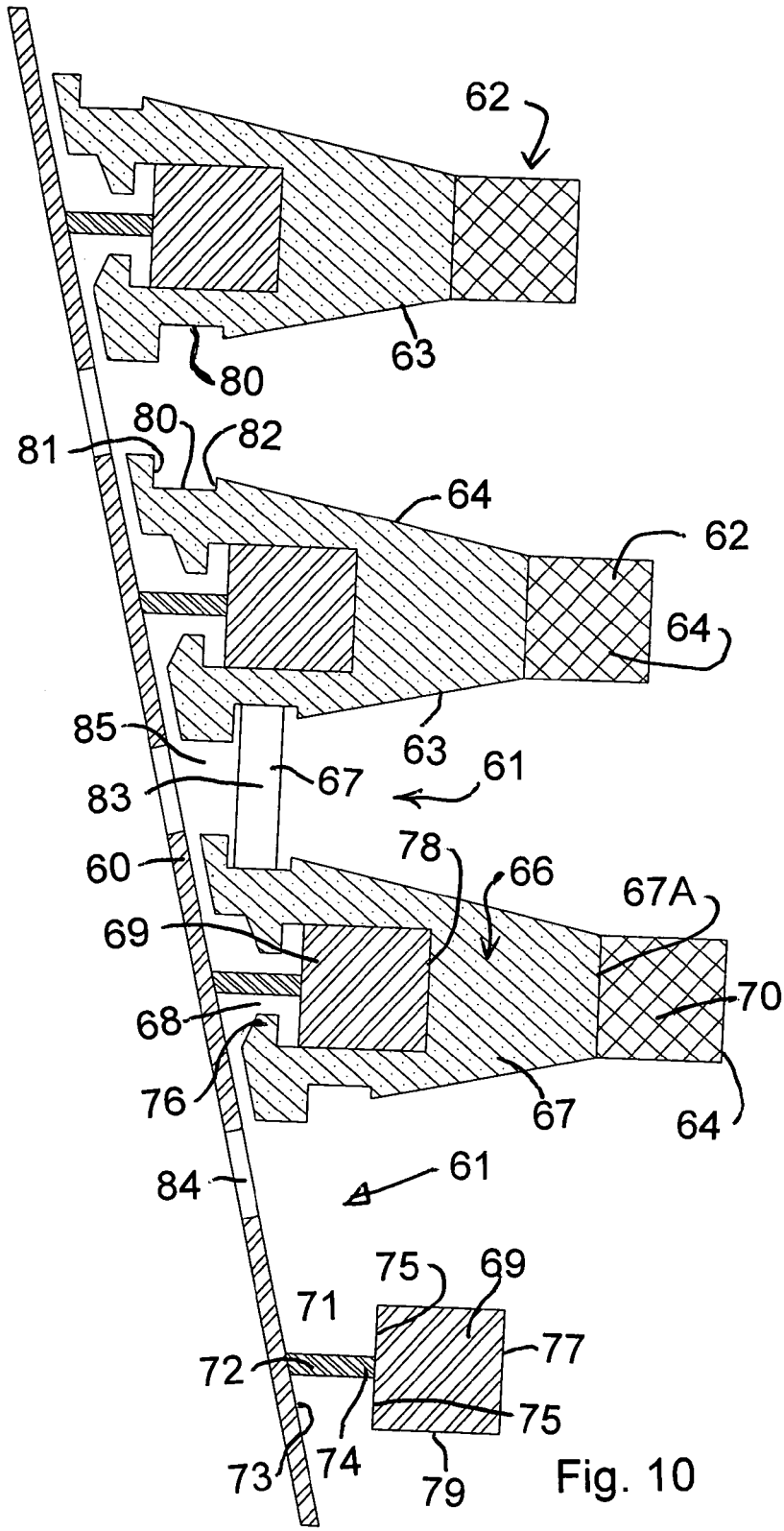
FIG. 10 is a cross sectional view through one portion of a bowl of a second embodiment of the present invention.

In the embodiment of FIG. 10 the peripheral wall 60 of the bowl has holes 84 so that water or other fluidizing liquid enters each recess 61 outwardly of the respective perforated insert member 67. Thus there is defined a channel 85 radially inwardly of the hole 84 outwardly of the perforated insert member. This channel extends around the periphery of the bowl so that the fluidizing liquid can escape from this channel inwardly through the perforated insert member. This arrangement is substantially as described in the above Canadian published application.

In FIG. 11 is shown an alternative arrangement where the wall indicated at 60A carries no perforations so that there is no necessity for an outside jacket. In this embodiment the structure of the wall may need to be strengthened since the wall itself provides structural stability for the bowl. In this embodiment the flanges 71A are perforated with holes 86. In this way water injected to the exterior of the recess insert members 66 as indicated by the arrow 87 passes along the inside surface 73A of the peripheral wall and outwardly of the recess insert members. This fluidizing liquid can therefore access each of the areas outwardly of the perforated insert members 67 to pass through the holes into the respective recess.

Figure 14:
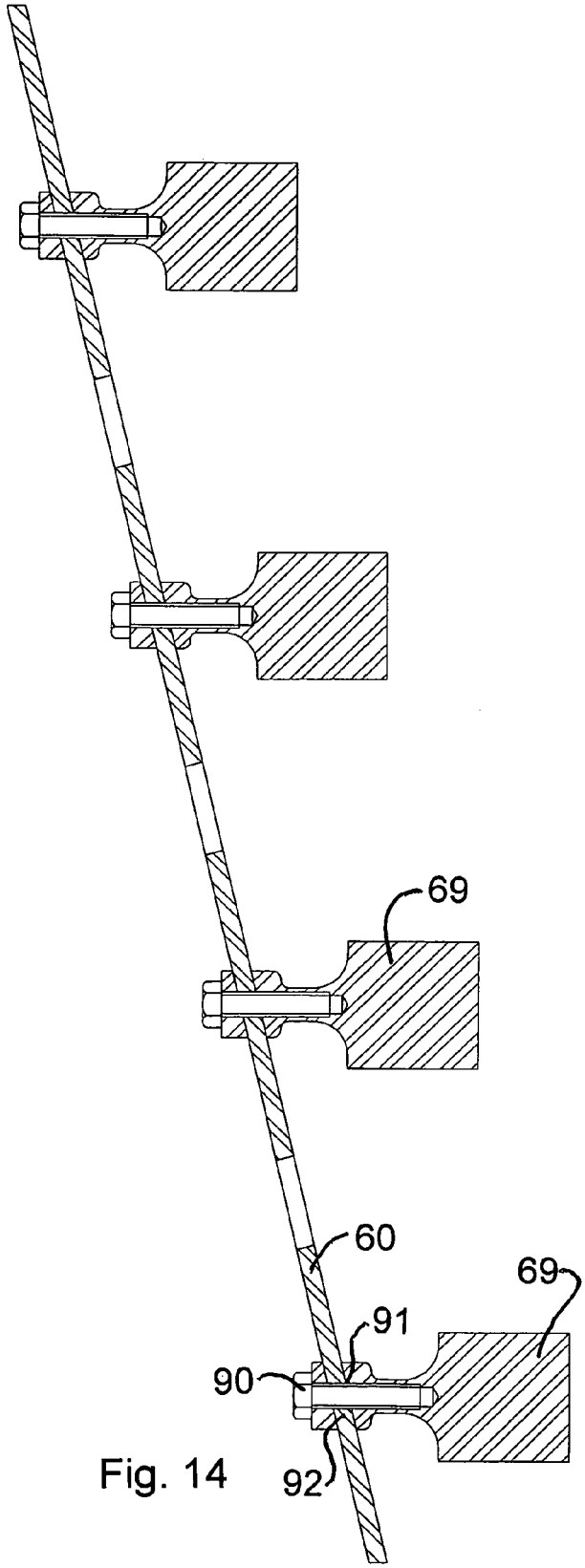
FIG. 14 is a further cross sectional view through a yet further embodiment showing the bowl alone.

It will be appreciated that the recess insert members can be mounted on the wall of the bowl by alternative members and alternative mounting arrangements. Firstly the shape of the annular band 69 may vary. Secondly the annular band can be omitted entirely and the insert members attached to the bowl of the wall by screws or other separate mounting elements which simply fasten into place into a base of the insert member. Thirdly the annular band 69 does not need to be welded to the inside surface of the bowl but could instead be bolted. Fourthly, as shown in FIG. 14, the band can be formed in separate pieces at spaced angular positions around the bowl. It will be appreciated that manufacturing accurately an annular band of a particular diameter and location may be difficult to that this can be overcome by making small pieces of for example 1 to 1.5 inches in length which are bolted onto the wall at for example 4 inch spacing so that the extruded insert is held in place at spaced positions but at spacing which holds it against deformation under centrifugal force. Thus the pieces may be held in place by bolts 90 passing through the wall 60. Suitable mounting washers 91 and 92 are provided inside and outside the peripheral wall 60 so as to support the pieces of the band 69 at a required position and other required orientation relative to the peripheral wall.

As shown in FIG. 13, suitable seals can be provided as indicated at 95 to prevent the escape of fluidizing water from behind the insert members so that the only escape of the fluidizing water is through the perforated insert members as required.

The invention claimed is:

1. A set of recess insert members:

for use in a centrifuge bowl for use in an apparatus for separating intermixed particulate materials of different specific gravity in a slurry where the apparatus includes:

a feed duct for feeding the slurry into the bowl so that during rotation of the bowl the intermixed particulate materials flow over a peripheral wall of the bowl for collection of heavier particulate materials on the peripheral wall and for discharge of the lighter particulate materials in the slurry from the open mouth;

a launder for collecting the lighter particulate materials in the slurry discharged from the open mouth;

a bowl;

the bowl having a base and a peripheral wall surrounding an axis passing through the base and generally upstanding from the base to an open mouth;

the bowl having a plurality of annular recesses on the peripheral wall at axially spaced positions over which the materials pass, when fed from the supply duct, so that the heavier particulate materials collect in the recesses;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least some of the recesses each having a fluidizing liquid injection system for fluidizing the materials in the respective recess including a liquid supply and at least one liquid entry opening extending from the supply into the recess at or closely adjacent the base of the recess;

each of the recess insert members comprising an elongate body shaped to extend only over a part of the height of the peripheral wall such that the set of recess insert members can be arranged at axially spaced positions in the bowl;

each of the recess insert members being shaped to extend around at least a part of the annular periphery of the peripheral wall;

each of the recess insert members being formed from a resilient material:

each of the recess insert members having at least one abutment element thereon for engaging a respective one of a plurality of co-operating elements of the bowl for holding the recess insert member in the bowl during rotation of the bowl;

the abutment element and the cooperating element being arranged such that the recess insert member is readily removable and replaceable;

each of the recess insert members being shaped to define an upper side wall of one of the recesses and a lower wall of a next adjacent one of the recesses with a rib therebetween such that, when two of the recess insert members are mounted in said axially spaced positions side by side, the recess insert members cooperate to define said one of the recesses therebetween.

2. The set of recess insert members according to claim 1 wherein the abutment member of each of the recess insert members comprises a channel around an outer face on the recess insert member for receiving an annular band of the peripheral wall of the bowl.

3. The set of recess insert members according to claim 1 wherein each of the recess insert members is annular and extends around the full periphery of the bowl to define butting ends of the recess insert member.

4. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth the bowl comprising a base and a peripheral wall surrounding an axis passing through the base and generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least one of the recesses each having a fluidizing liquid injection system for fluidizing the materials in the respective recess including a liquid supply and at least one liquid entry opening extending from the supply into the recess at or closely adjacent the base of said one of said recesses;

and at least one recess insert member mounted in a respective one of the recesses in the bowl;

the recess insert member being shaped to extend only over a part of the height of the peripheral wall;

the recess insert member being elongate and shaped to extend around at least a part of the annular periphery of the peripheral wall;

the recess insert member being formed from a resilient material;

the recess insert member having at least one abutment element thereon for engaging a co-operating element of the bowl for holding the recess insert member in the bowl during rotation of the bowl;

the abutment element and the cooperating element being arranged such that the recess insert member is readily removable and replaceable;

wherein the recess insert member includes a side portion arranged to be located radially inwardly of a respective one of the ribs on a respective side of a respective one of the recesses and at least partly covering the respective one of the ribs fib so as to prevent the slurry from contacting the respective one of the ribs and causing wear to the respective one of the ribs.

5. The centrifuge bowl according to claim 4 wherein of the recess insert member includes a radially inwardly facing surface which is arranged to extend across the recess and onto the side portion.

6. The centrifuge bowl according to claim 5 wherein the surface is shaped to define at least one surface recess radially inwardly of the recess.

7. The centrifuge bowl according to claim 4 wherein the recess insert member includes two side portions each on a respective side of the recess and each arranged to cover a respective one of the ribs on opposite sides of the recess.

8. The centrifuge bowl according to claim 4 wherein the side portion of the recess insert member has an edge at an axial end thereof and an edge surface extending from the edge to a next adjacent recess and wherein the edge surface is arranged to be substantially contiguous with a side wall of the next adjacent recess.

9. The centrifuge bowl according to claim 4 wherein the respective one of the ribs has a radially inwardly facing surface and wherein the side portion of the recess insert member has a radially outwardly facing surface arranged to be in contact with and resting against the radially inwardly facing surface of the respective one of the ribs.

10. The centrifuge bowl according to claim 4 wherein the recess insert member is annular and extends around the full periphery of the respective one of the recesses to fill the respective one of the recesses to define butting ends of the recess insert member.

11. The centrifuge bowl according to claim 4 wherein the recess insert member has side walls arranged to be in contact with and resting against the side walls of the respective one of the recesses.

12. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

the peripheral wall of the bowl having attached thereto a plurality of axially spaced annular bands each arranged for mounting thereon an abutment element of a respective one of a plurality of recess insert members, the abutment element and the annular band being arranged such that the recess insert member is readily removable and replaceable.

13. The bowl according to claim 12 wherein the annular band defines shoulders for engaging into a channel on the recess insert member.

14. The bowl according to claim 12 wherein there is provided a liquid supply for a fluidizing liquid injection system for fluidizing the materials in the respective recess which includes a channel defined between an exterior of the at least one recess insert member and an interior of the peripheral wall, the channel passing through the annular bands.

15. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least one of the recesses each having a fluidizing liquid injection system for fluidizing the materials in the respective recess including a liquid supply and at least one liquid entry opening extending from the supply into the recess at or closely adjacent the base of said one of said recesses;

at least a part of at least one side wall of at least one of the recesses being formed from a recess insert member mounted in the bowl;

the recess insert member being elongate and shaped to extend only over a part of the height of the peripheral wall;

the recess insert member being elongate and shaped to extend around at least a part of the annular periphery of the peripheral wall;

the recess insert member being formed from a resilient material;

the recess insert member having at least one abutment element thereon for engaging a cooperating element of the bowl for holding the recess insert member in the bowl during rotation of the bowl;

the abutment element and the cooperating element being arranged such that the recess insert member is readily removable and replaceable.

16. The centrifuge bowl according to claim 15 wherein there are at least two recess insert members arranged at axially spaced locations where one defines the lower side wall of a recess and a second defines the upper side wall of a recess.

17. The centrifuge bowl according to claim 16 wherein there is provided a perforated insert member mounted in the recess between the two recess insert members at a position therein so as to define a channel between the side walls, inwardly of the base and outwardly of the perforated insert member within which the fluidizing liquid from the liquid entry opening can flow within the recess, the perforated insert member having an inwardly facing surface which spans the space between the side walls at the perforated insert member so as to confine the materials within the volume of the recess defined by the side walls and inwardly of the inwardly facing surface of the perforated insert member, the perforated insert member having an array of fluid injection holes defined therethrough which allow the injection of jets of fluidizing liquid from the channel through the perforated insert member into the volume.

18. The centrifuge bowl according claim 15 wherein the recess insert member is shaped to define an upper side wall of one recess and a lower wall of a next adjacent recess with a slurry engaging surface of a rib therebetween.

19. The centrifuge bowl according to claim 18 wherein the slurry engaging surface is shaped with at least one angularly extending recess thereon for contacting and changing slurry flow over the surface.

20. The centrifuge bowl according to claim 18 wherein the recess insert member includes a layer of a material attached thereto at the slurry engaging surface which is of increased wear resistance relative to a main material from which the recess insert member is formed.

21. The centrifuge bowl according to claim 20 wherein the layer is attached by adhesive.

22. The centrifuge bowl claim 15 wherein the peripheral wall of the bowl has attached thereto, for the recess insert member, a mounting member extending inwardly from the wall for engaging an abutment member on the recess insert member.

23. The centrifuge bowl according to claim 22 wherein the mounting member comprises an annular band carried on the peripheral wall.

24. The centrifuge bowl according to claim 23 wherein the annular band defines shoulders for engaging into a channel on the recess insert member.

25. The centrifuge bowl according to claim 15 wherein the liquid supply of the fluidizing liquid injection system for fluidizing the materials in said at least one of the recesses includes a channel defined between an exterior of the at least one recess insert member and an interior of the peripheral wall.

26. The centrifuge bowl according to claim 15 wherein the recess insert member is annular and extends around the full periphery of the bowl to define butting ends of the recess insert member.

27. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least one of the recesses each having a fluidizing liquid injection system for fluidizing the materials in the respective recess including a liquid supply and at least one liquid entry opening extending from the supply into the recess at or closely adjacent the base of said one of said recesses;

and at least two recess insert members mounted in the bowl at axially spaced positions along the bowl and arranged such that at least a part of at least one side wall of at least one of the recesses is formed from a respective one of the recess insert members;

each recess insert member being shaped to extend only over a part of the height of the peripheral wall;

each recess insert member being elongate and shaped to extend around at least a part of the annular periphery of the peripheral wall;

each recess insert member being formed from a resilient material;

each recess insert member having at least one abutment element thereon for engaging a respective one of at least two co-operating elements of the bowl for holding the recess insert member in the bowl during rotation of the bowl;

the abutment element and the co-operating element being arranged such that the recess insert members are readily removable and replaceable;

wherein one of the recess insert members defines a lower side wall of one of the recesses and a second of the recess insert members defines an upper side wall of said one of the recesses.

28. The centrifuge bowl according to claim 27 wherein there is provided a perforated insert member mounted in said one of the recesses defined between the two recess insert members at a position therein so as to define a channel between the side walls, inwardly of the base and outwardly of the perforated insert member within which the fluidizing liquid from the liquid entry opening can flow within said one of the recesses, the perforated insert member having an inwardly facing surface which spans the space between the side walls at the perforated insert member so as to confine the materials within the volume of said one of the recesses defined by the side walls and inwardly of the inwardly facing surface of the perforated insert member, the perforated insert member having an array of fluid injection holes defined therethrough which allow the injection of jets of fluidizing liquid from the channel through the perforated insert member into the volume.

29. The centrifuge bowl according to claim 28 wherein the recess insert member is annular and extends around the full periphery of the bowl to define butting ends of the recess insert member.

30. The centrifuge bowl claim 27 wherein the co-operating element of the bowl, for each of the recess insert members, comprises a mounting member attached to the peripheral wall and extending radially inwardly from the peripheral wall for engaging the abutment member on the recess insert member.

31. The centrifuge bowl according to claim 30 wherein the mounting member for each of the recess insert members comprises an annular band carried on the peripheral wall for engaging into a channel on the recess insert member.

32. A centrifuge bowl for use in an apparatus for separating intermixed particulate materials of different specific gravity in a slurry where the apparatus includes a feed duct for feeding the slurry into the bowl during rotation of the bowl so that during rotation of the bowl the intermixed particulate materials flow over a peripheral wall of the bowl for collection of heavier particulate materials on the peripheral wall and for discharge of the lighter particulate materials in the slurry from the open mouth and a launder for collecting the lighter particulate materials in the slurry discharged from the open mouth, the bowl comprising a base and a peripheral wall surrounding an axis passing through the base and generally upstanding from the base to an open mouth;

and a plurality of annular recesses on the peripheral wall at axially spaced positions over which the materials pass when fed from the supply duct;

each recess being defined by an upper recess side wall on the upper side and a lower recess side wall on a lower side with each of the side walls extending generally outwardly from the axis from an open mouth of the recess toward a base of the recess at the peripheral wall;

the upper side wall of each recess being connected to the lower side wall of a next adjacent recess to form a rib between the recesses such that the bowl includes a plurality of recesses and a plurality of ribs arranged alternately along the side wall;

at least one of the recesses each having a fluidizing liquid injection system for fluidizing the materials in the respective recess including a liquid supply and at least one liquid entry opening extending from the supply into the recess at or closely adjacent the base of said one of said recesses;

and a plurality of recess insert members mounted in the bowl at axially spaced positions along the bowl and arranged such that at least a part of at least one side wall of at least one of the recesses is formed from a respective one of the recess insert members;

each recess insert member being shaped to extend only over a part of the height of the peripheral wall;

each recess insert member being elongate and shaped to extend around at least a part of the annular periphery of the peripheral wall;

each recess insert member being formed from a resilient material;

each recess insert member having at least one abutment element thereon for engaging a respective one of a plurality of cooperating elements of the bowl for holding the recess insert member in the bowl during rotation of the bowl;

the abutment elements and the cooperating elements being arranged such that the recess insert members are readily removable and replaceable;

wherein each recess insert member is shaped to define an upper side wall of one of the recesses and a lower wall of a next adjacent one of the recesses with a rib therebetween such that two side by side recess insert members cooperate to define said one of the recesses therebetween.

33. The centrifuge bowl claim 32 wherein the co-operating element of the bowl, for each of the recess insert members, comprises a mounting member attached to the peripheral wall and extending radially inwardly from the peripheral wall for engaging the abutment member on the recess insert member.

34. The centrifuge bowl according to claim 33 wherein the mounting member for each of the recess insert members comprises an annular band carried on the peripheral wall for engaging into a channel on the recess insert member.

35. The centrifuge bowl according to claim 32 wherein the recess insert member is annular and extends around the full periphery of the bowl to define butting ends of the recess insert member.

* * * * *